US011787604B2

(12) United States Patent
Ferrari et al.

(10) Patent No.: US 11,787,604 B2
(45) Date of Patent: Oct. 17, 2023

(54) CAP FOR A CONTAINER WITH A HINGED LID

(71) Applicant: Affaba & Ferrari S.r.l., Borgo San Giovanni (IT)

(72) Inventors: Silvia Ferrari, Lodi (IT); Guglielmo Ferrari, Lodi (IT)

( * ) Notice: Subject to any disclaimer, the term of this patent is extended or adjusted under 35 U.S.C. 154(b) by 0 days.

(21) Appl. No.: 17/713,089

(22) Filed: Apr. 4, 2022

(65) Prior Publication Data

US 2022/0324619 A1 Oct. 13, 2022

(30) Foreign Application Priority Data

Apr. 7, 2021 (IT) ..... 102021000008564

(51) Int. Cl.
*B65D 47/08* (2006.01)
*B65D 41/16* (2006.01)

(52) U.S. Cl.
CPC ..... *B65D 47/0838* (2013.01); *B65D 41/16* (2013.01); *B65D 47/0814* (2013.01); *B65D 47/0861* (2013.01); *B65D 2401/15* (2020.05)

(58) Field of Classification Search
CPC ..... B65D 47/0838; B65D 41/16; B65D 47/0861; B65D 2401/15; B65D 47/243; B65D 47/0814
See application file for complete search history.

(56) References Cited

U.S. PATENT DOCUMENTS

| | | | | |
|---|---|---|---|---|
| 4,403,712 | A | 9/1983 | Wiesinger | |
| 9,415,909 | B2 * | 8/2016 | Druitt | B65D 47/0809 |
| 2005/0045669 | A1 | 3/2005 | Thunberg | |
| 2010/0005641 | A1 * | 1/2010 | Druitt | B65D 55/16 215/237 |
| 2011/0000137 | A1 | 1/2011 | Druitt | |
| 2011/0000871 | A1 * | 1/2011 | Bernard | B65D 55/16 215/235 |
| 2020/0399030 | A1 | 12/2020 | Jelich | |

OTHER PUBLICATIONS

Italian Patent and Trademark Office, Search Report, dated Nov. 25, 2021 (Relevant portions are in English).

* cited by examiner

*Primary Examiner* — James N Smalley
(74) *Attorney, Agent, or Firm* — Themis Law

(57) ABSTRACT

A cap for a container with a hinged lid includes a first part and a second part that are snap-associated. The first part has a lower cylindrical portion and an upper cylindrical portion, and the second part includes a covering lid having an annular portion and a lid portion and a hinge arrangement therebetween, which includes a strip arranged in a window opening formed in the side surface of the lid portion and open towards the annular portion. The strip has weakened foldable end areas connected to the annular and lid portions, and a folding invitation line that divides the strip into two portions with a central recess therebetween. Folding invitation lines are also provided between the two portions of the strip and an end edge of the opening in the lid portion.

12 Claims, 4 Drawing Sheets

CAP FOR A CONTAINER WITH A HINGED LID

FIELD OF THE INVENTION

The present invention relates to a cap for a container with a hinged lid.

BACKGROUND OF THE INVENTION

Closing caps on containers for beverages and other liquid products, such as drinks with vitamin supplements, water with additives in general, juices, tea, etc. are of the most varied and different types.

Closing caps are provided, for example, that have a protective dome to be removed before use and which then remain uncovered in their upper part.

In these caps, there is also the possibility of having an opening and a closure of the same for dispensing with a minimum guarantee that the internal product is that originally inserted by the filler company. And, as mentioned, once the first opening has been effected, the upper dispenser remains uncovered subject to contamination and with the possibility of becoming dirty.

The presence of the removable dome can be subjected to manipulation with no guarantee for the user that the cap has not already been opened or tampered with to replace the contents with a less valuable product.

Furthermore, the upper dome, once opened, becomes detached from the cap and can pollute the environment.

There is currently a request for a dome that somehow remains constrained to the cap and therefore does not become detached from the same, allowing however easy drinking from the container.

Caps have been produced having an at least partially overturnable upper covering part that create some difficulty for the person who is drinking. The rotated opening part, in fact, in some way obstructs access to the mouth and the consequent fruition of the drink. If, on the other hand, the covering part becomes detached from the part integral with the container, it remains detached and, as already mentioned, it does not respond to the requirement of not becoming dispersed in the environment, separating itself from the part constrained to the container.

The document US 2011/000137 relates to a cap according to the prior art.

SUMMARY OF THE INVENTION

The objective of the present invention is therefore to define an adequate and different solution to the technical problems indicated above.

A further objective of the invention is to create a cap for a container with a lid that favours access to the fruition of the drink directly from the mouthpiece, the lid however remaining integral with the container itself.

Another objective of the invention is to create a cap easy to construct, with a minimum number of parts and inexpensive, and also particularly simple to use and operate.

Yet another objective of the invention is to provide a cap of the above-mentioned type in which the lidded part, once opened and rotated away from the mouthpiece, remains in this position well-detached and without creating any obstacle for the use of the beverage.

A further general objective of the present invention is to provide a cap capable of solving the above-mentioned drawbacks of the known art in an extremely simple, economical and particularly functional way.

The above objectives are achieved by a cap for a container with a hinged lid produced according to the invention.

BRIEF DESCRIPTION OF THE DRAWINGS

The structural and functional characteristics of the present invention and its advantages with respect to the known art will become more evident from the following description, referring to the attached schematic drawings, which show an embodiment example of the invention itself. In the drawings.

DETAILED DESCRIPTION OF EMBODIMENTS OF THE INVENTION

Figure 1:
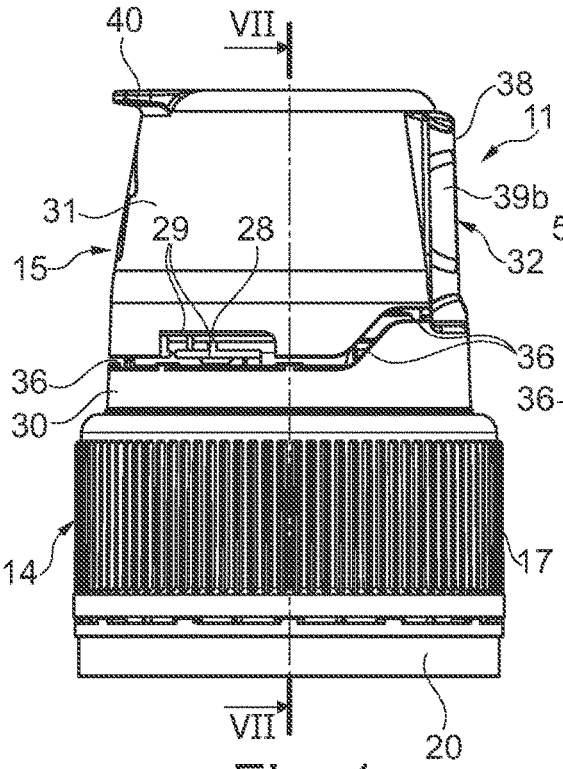
FIGS. 1 and 2 are raised side views of the cap for a container with a hinged lid rotated by 90° with respect to each other.

With reference to the figures, in the following description, identical reference numbers are used for indicating construction elements with the same function. Furthermore, for clarity of illustration, some numerical references may not have been repeated in all the figures. Indications such as "vertical" and "horizontal", "upper" and "lower" (in the absence of other indications) should be read with reference to the assembly (or operating) conditions and referring to the normal terminology used in current language, wherein "vertical" indicates a direction substantially parallel to that of the force of gravity vector "g" and a horizontal direction perpendicular to it.

The present invention relates to a cap for a container with a hinged lid according to the present invention, indicated as a whole with 11, according to the embodiments shown in the figures.

The closure cap 11 is suitable for being placed on a screw neck of a mouthpiece of a container (not shown).

The cap 11 essentially comprises at least two parts, i.e. a first part 14 and a second part 15 snapped-engaged with each other on assembly.

The first part 14 comprises a cylindrical base body which provides a first lower cylindrical portion having a larger diameter 17 and a second upper cylindrical portion with a smaller diameter 21 coaxial with respect to each other.

The first lower cylindrical portion having a larger diameter 17 is internally threaded in 18, so that it can be positioned on a screw neck of a mouthpiece of a container (not shown) to form the positioning part of the cap on the container. The second upper cylindrical portion with a smaller diameter 21 forms the pouring part of the cap.

A lower end of this first cylindrical portion having a larger diameter 17 extends through frangible bridges 19 into an annular tamper-proof crown 20 which is positioned under a radial annular protrusion towards the outside of the screw neck of a container.

From the first cylindrical portion having a larger diameter 17 of the cylindrical base body of the cap, a second upper cylindrical portion with a smaller diameter 21 extends coaxially upwards, which, as already mentioned, forms the pouring part.

The first cylindrical portion 17 and the second cylindrical portion 21 are coaxial and are connected by means of a central hole 22.

Furthermore, sealing means are associated with the second upper cylindrical portion having a smaller diameter 21 for sealing the second upper cylindrical portion having a smaller diameter 21 which forms the pouring part of the cap.

In the example shown in FIGS. 1 to 7, these sealing means are created by a shutter element 23, axially movable with respect to the second upper cylindrical portion with a smaller diameter 21 of the cylindrical base body. The shutter element 23 comprises two tubular portions, one external 24 and the other internal 25, coaxial and connected at the top. The internal tubular portion 25 is also connected at the bottom by means of radial bridges 26 to an island shutter 27 suitable for being positioned in the central hole 22 closing the connection between the first cylindrical portion having a larger diameter 17 and the second upper cylindrical portion with a smaller diameter 21 of the cylindrical base body of the cap.

As already indicated, the shutter element 23 is axially movable with respect to the second upper cylindrical portion having a smaller diameter 21 of the cylindrical base body between a closing position of the hole 22 and an opening position of the same hole 22 for the passage of the beverage.

In order to limit the lifting and/or lowering run of the shutter element 23 with respect to the second upper cylindrical portion having a smaller diameter 21 of the cylindrical base body, a particular arrangement is provided. A free upper end of the upper cylindrical portion 21, in fact, provides a radial annular extension 48 towards the outside of the run-end which collaborates with an annular relief 49 formed on an internal wall of the external tubular portion 24 of the shutter element 23.

The collaboration between the annular extension 48 and the annular relief 49 define the space of the lowering and lifting run of the shutter element 23 with respect to the upper cylindrical portion 21 of the cap.

With respect now to the structure of the cap 11, it has been specified that it also consists of a second part 15 snap-engaged with the first part 14 on assembly by means of an end ring or annular portion 30 as a lower extension of the second part 15.

This second part 15 forms a covering lid which comprises below a lower annular portion 30 and an upper lid portion 31 connected to each other by a hinge arrangement 32.

The annular portion 30 of the second part 15 has an internal perimetric annular projection 33 projecting inwardly which is snap-coupled with an annular projection 34 formed externally above a flanging 35 provided in an upper part of the first cylindrical portion having a larger diameter 17. The annular projection 34 protrudes outwardly and collaborates with the above-mentioned annular projection 33 snap-blocking the parts, i.e. the second part 15 with respect to the first part 14.

The annular portion 30 and the lid portion 31 are connected at least partially to each other by a series of frangible bridges 36 which break when the parts are opened.

The annular portion 30 and the lid portion 31 are further connected to each other by a tamper-proof rod 28 which is firmly constrained and pivoted at a lower end 16 to the annular portion 30. Further frangible bridges 29 connect this tamper-proof rod 28 to both the annular portion 30 and also to the lid portion 31, and break at the first opening ensuring the integrity and originality of the cap 11.

The hinge arrangement 32 comprises a strip 37 which is integrally constrained by its weakened foldable end areas 53, 54 on one side to the annular portion 30 and on the other to an upper edge 50 of a window opening 44 formed in the side surface of the lid portion 31 which is open towards the annular portion 30.

The weakened foldable end areas 53, 54 are connected to two rigid connecting sectors 41 and 45 which respectively extend from the annular portion 30 and from the upper edge 50 of the opening 44 laterally into the lid portion 31. In this way, the strip 37 is movably positioned in the opening 44 allowing the movement of the lid portion 31 with respect to the annular portion 30.

A folding invitation line 38 is also provided, centrally arranged longitudinally in the strip 37, almost parallel to the axis of the cap.

The folding invitation line 38 divides the strip into two and defines two portions 39*b* and 39*c* by means of a thinned central recess 55. These two portions 39*b* and 39*c* border centrally on this recess 55 and at their opposite ends on the weakened foldable end areas 53, 54.

In this way, due to the presence of the weakened foldable end areas 53, 54 and the central recess 55, the two portions 39*b* and 39*c* of the strip 37 are snap-foldable, oscillating around the central folding invitation line 38 and this occurs according to the position in which the strip 37 is positioned or rather moved. As will be better seen hereunder, the two portions 39*b* and 39*c* of the strip 37 are snap-foldable between two predetermined positions which cause the lid portion 31 to be kept either in the closed position or in the fully open position.

Figure 2:
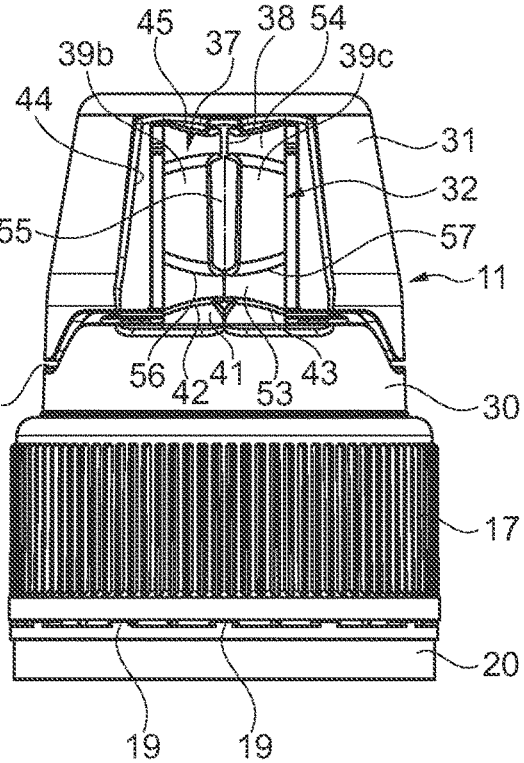
Figure 2B:
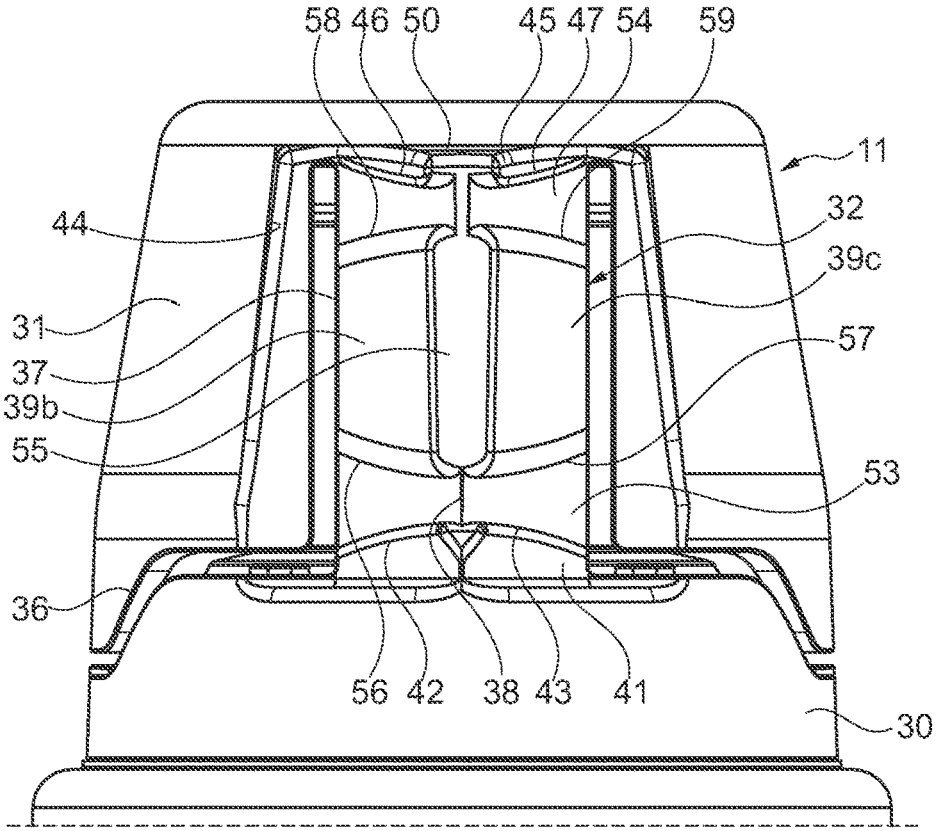
FIG. 2*b* shows an enlarged detail of what is shown in FIG. 2.

In the closed position of the lid portion 31, in fact, arranged above the second upper cylindrical pouring portion having a smaller diameter 21, the whole strip 37 is aligned for being arranged for closure of the side opening 44 of the lid portion 31 (FIGS. 2 and 2*b*).

The two portions 39*b* and 39*c* are arranged so that with the central recess 55 and the central invitation line 38, which connect them, they define a V-section in the direction transversal to the strip. The two portions 39*b* and 39*c* define the sides of the V pointing outwardly in this closed position (FIGS. 2, 2*b*, 8 and 9) and the tip coincides with the central invitation line 38.

It should also be noted that the first weakened foldable end area 53 is connected to the first rigid connection sector 41, which extends from the annular portion 30, by means of two folding invitation lines 42, 43, tilted and converging towards the central invitation line 38.

The second weakened foldable end area 54 is connected on one side to the rigid connection sector 45, which extends from the end edge 50 of the opening 44 in the lid portion 31, by means of two folding invitation lines 46, 47, which also converge towards the central folding invitation line 38.

The first weakened folding end area 53 is then connected at its other end to the two portions 39*b* and 39*c* by folding lines 56 and 57.

The second weakened folding end area 54 is then connected at its other end to the two portions 39*b* and 39*c* through folding lines 58 and 59.

These arrangements of rigid connection sectors 41 and 45 at the end of the strip 37 govern the reciprocal movement of the two portions 39*b* and 39*c* in collaboration with all of the folding invitation lines 42, 43, 56 and 57 on one side and 46, 47, 58 and 59 on the other. In this way, together with the two portions 39*b* and 39*c* of the strip 37, a double-jointed hinge is formed in the zones or application areas of the strip 37 to the annular portion 30 and to the lid portion 31 which allows a wide and easy movement thereof with respect to the remaining parts of the cap.

Figure 9:
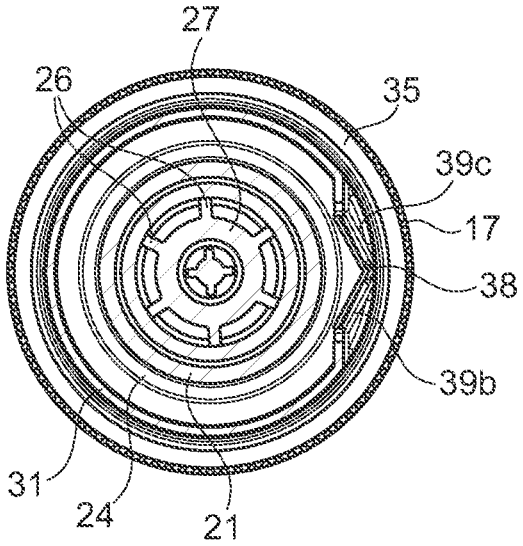
FIG. 9 is a plan view in a section according to the line IX-IX of FIG. 8.

In the position of the lid portion 31 closed and integral with the annular portion 30, in fact, the two portions 39*b* and 39*c* tend to keep the strip aligned with the side surface of the lid portion 31 with their V-shaped section with the tip (i.e. central invitation line 38) facing outwardly (FIG. 9).

By acting on a flap 40 arranged above in the lid portion 31, the frangible bridges 36 which connect the lid portion 31 to the annular portion 30 are broken.

The further bridges 29 which connect the tamper-proof rod 28 to both the annular portion 30 and to the lid portion 31 are also broken. The tamper-proof rod 28 remains in any case constrained at its lower end 16 to the annular portion 30 and connected to only one of its ends showing that a first opening of the lid portion 31 of the cap 11 has been effected.

The lid portion 31 can therefore be lifted in rotation around the hinge arrangement 32 away from the annular portion 30.

Figure 3:
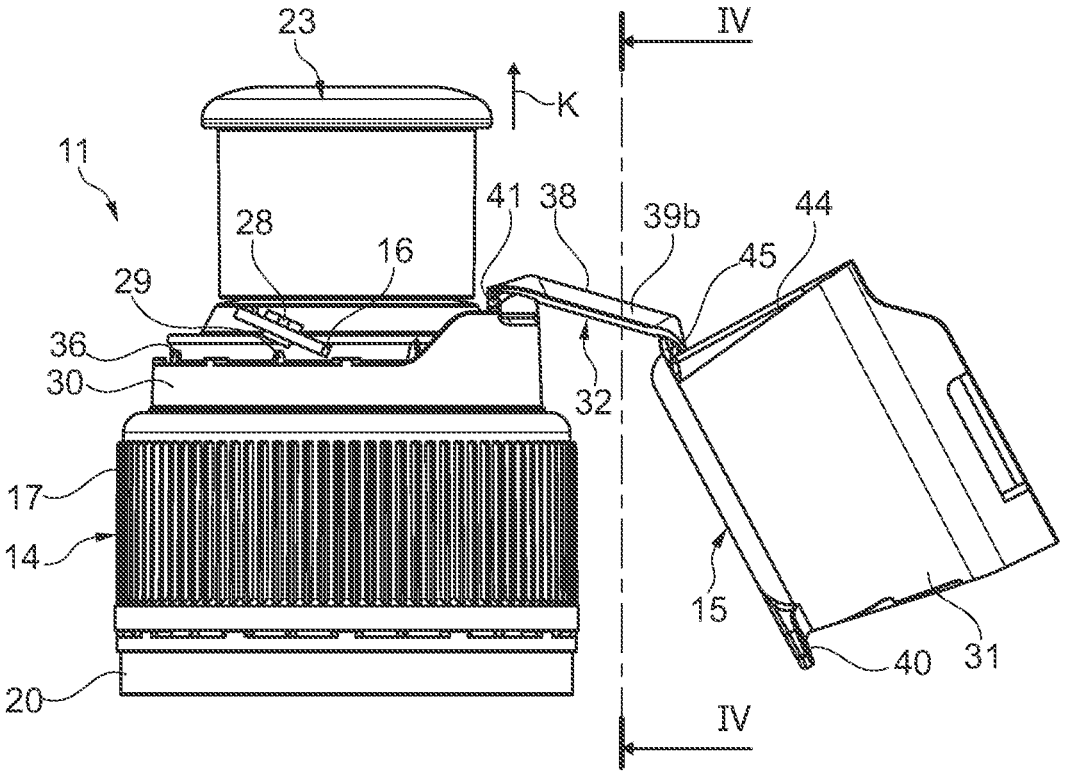
FIG. 3 is a raised side view of the cap once the lid has been opened and rotated at its maximum opening with respect to the mouthpiece.
Figure 4:
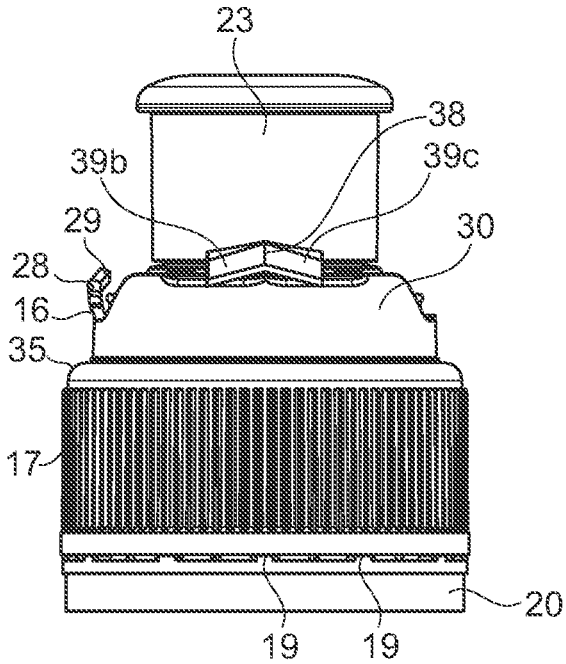
FIG. 4 is a raised sectional view of the cap according to the line IV-IV of FIG. 3.
Figure 5:
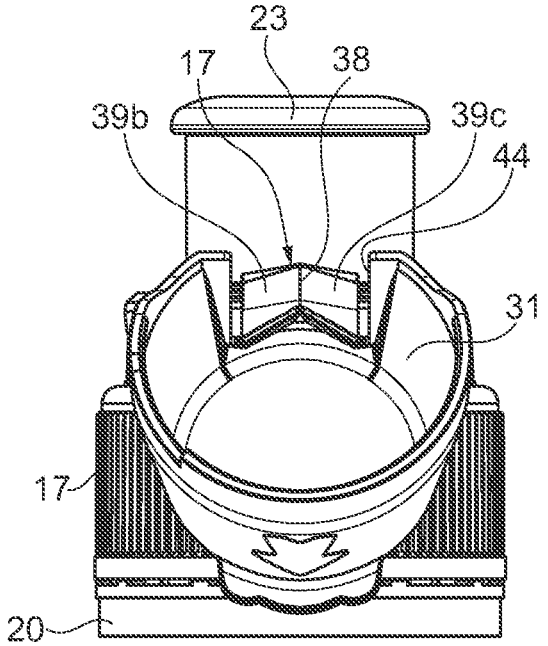
FIG. 5 is a raised side view of the cap according to the arrow F of FIG. 3 with the lid opened and rotated with the maximum opening of the lid.

During this rotation movement for bringing the lid portion 31 in a completely open position, as shown in FIG. 3, the two connection sectors 41 and 45 at the end of the strip 37, as already mentioned, govern the reciprocal movement of the two portions 39*b* and 39*c*.

And in this case they force the two portions 39*b* and 39*c* to move from a first rest position with their V-section (i.e. central invitation line 38) with the tip facing outwardly to a second completely open position of the lid portion 31 with their V-section (i.e. central invitation line 38) facing inwardly.

The arrangement of the two portions 39*b* and 39*c* exerts a blocking action of the lid portion 31 in this completely open position.

The user can thus easily enjoy the drink from the pouring part or from the second upper cylindrical portion with a smaller diameter 21 of the first part 14 of the cap 11. This is possible once the shutter 23 has been axially moved with respect to the second upper cylindrical portion having a smaller diameter 21 of the cylindrical base body according to the arrow K to free the central hole 22. The central hole 22 has been seen to be a connection between the first cylindrical portion having a larger diameter 17 and the second upper cylindrical portion with a smaller diameter 21 of the cylindrical base body of the cap.

Figure 10:
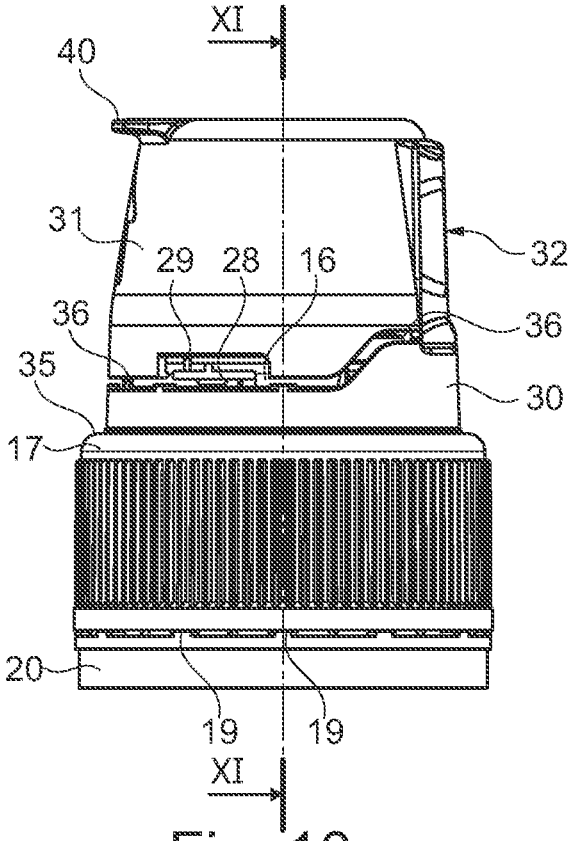
FIG. 10 is a raised side view of a second embodiment of the cap according to the present invention.
Figure 11:
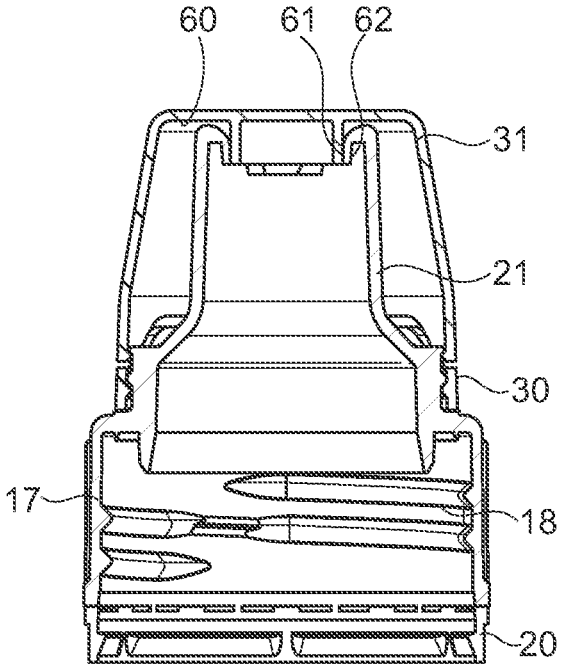
FIG. 11 is a raised sectional view of the cap according to the line IX-IX of FIG. 8.

FIGS. 10 and 11 show a second embodiment of the cap of the present invention wherein the shutter element 23 of the previous example has been eliminated thus reducing the parts of the cap to only two.

In this second embodiment, identical elements are indicated with the same reference numbers.

Also in this case, the lid portion 31 can be opened with respect to the lower part of the cap due to the provision of the hinge arrangement 32 previously described.

In this second embodiment, different sealing means are provided for the second upper cylindrical portion with a smaller diameter 21 which forms the pouring part of the cap.

In this case, in fact, the second part 15 which forms the covering lid provides that a cylindrical shutter element 61 extends inwardly from a wall 60 positioned for closing the lid portion 31, forming the sealing means. This shutter element 61 is arranged in engagement with a lip 62 protruding inwardly at the upper open end of the second upper cylindrical portion having a smaller diameter 21 of the first part 14 of the cap 11.

Consequently, in this second example, by acting on the flap 40 arranged above in the lid portion 31, as in the first example, the frangible bridges 36 which connect the lid portion 31 to the annular portion 30, are broken.

This also causes the breakage of the further bridges 29 that connect the tamper-proof rod 28 to both the annular portion 30 and the lid portion 31 with evidence of the first opening of the lid portion 31 of the cap 11.

The lid portion 31 can therefore be lifted in rotation around the hinge arrangement 32 away from the annular portion 30.

With this rotation, there is a simultaneous disengagement of the shutter element 61 from the lip 62 of the second upper cylindrical portion having a smaller diameter 21.

Figure 6:
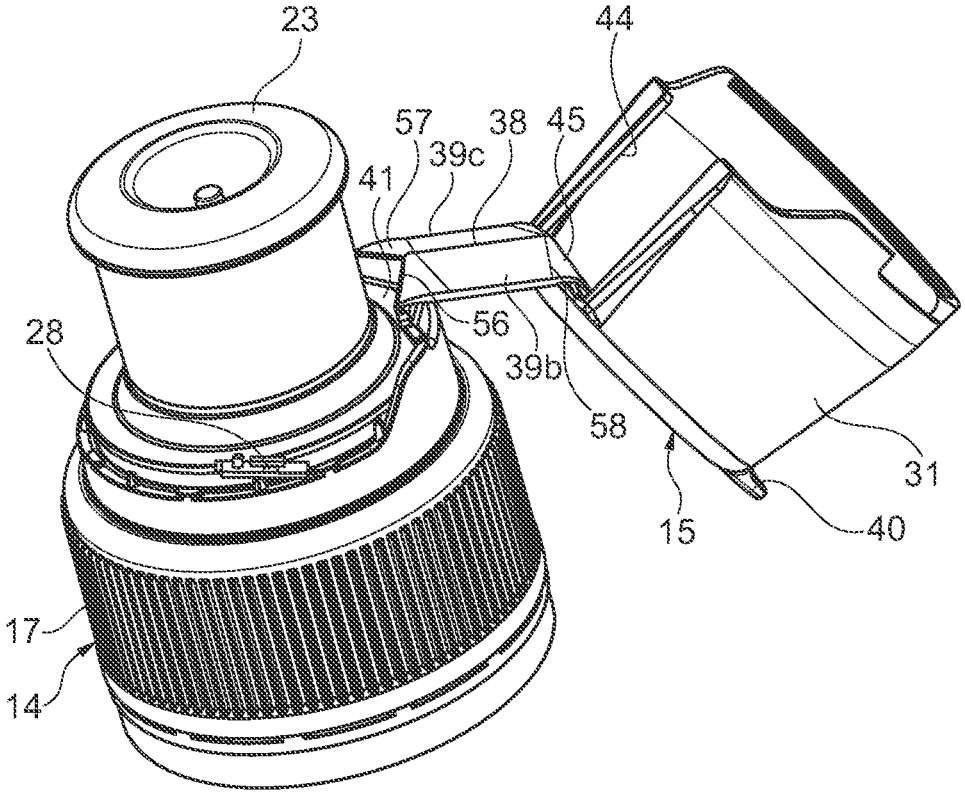
FIG. 6 is a perspective view of the cap shown in FIG. 3 with the protective lid open.
Figure 7:
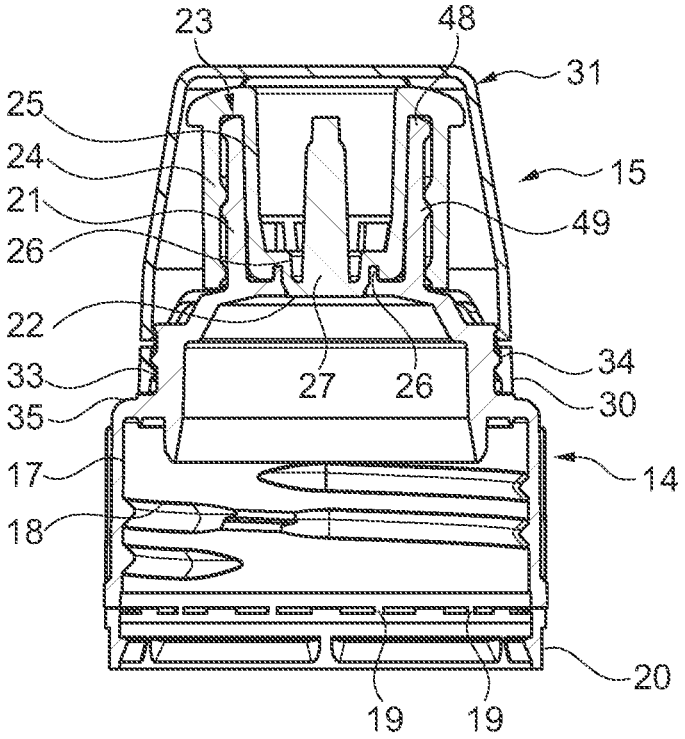
FIG. 7 is a raised sectional view of the cap according to the line VII-VII of FIG. 1.
Figure 8:
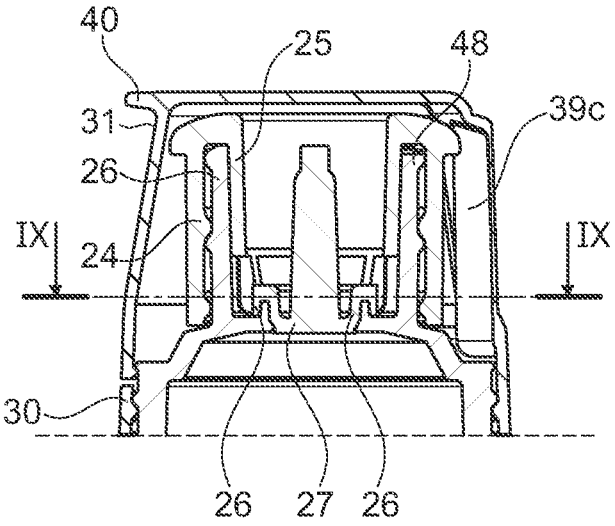
FIG. 8 is a raised sectional view of part of the cap rotated by 90° around the axis of the cap with respect to the section shown in FIG. 7.

In this way, the beverage is accessible for use, and also in this case the lid portion 31 remains open as shown in FIGS. 3 and 6 due to the provision of the particular hinge arrangement 32. Also in this case, in fact, according to the present invention, there is a hinge arrangement 32 created with the strip 37, divided by an invitation line 38, into two portions 39*b* and 39*c* which are snap-foldable between the two predetermined positions indicated above.

It has thus been seen that in both embodiments described and shown in two or three parts, the lid portion 31 can be moved between a closed position above the first part 14 still fully joined to the annular portion 30 and a completely open overturned position alongside the first part 14 joined by one end of the strip 37 to the edge 50 of the opening 44. It has also been seen that the strip 37 is kept in these two positions due to the fact that it is divided into two portions 39*b* and 39*c* which are snap-foldable when in the two predetermined positions.

Furthermore, the provision of a tamper-proof rod 28 between the annular portion 30 and the lid portion 31 guarantees the integrity and non-opening of the cap 11.

All of the objectives mentioned in the presentation of the prior art set out in the preamble of the description have thus been achieved.

The embodiments of the structure for producing a cap of the invention, as also the materials and assembly methods, can naturally differ from those shown for purely illustrative and non-limiting purposes in the drawings.

The protection scope of the present invention is defined by the enclosed claims

The invention claimed is:

1. A cap for a container with a hinged lid, comprising:

a first part; and a second part, the first part and the second part being adapted to be snap-engaged with each other, wherein:

the first part comprises a cylindrical base body having a first lower cylindrical portion with a larger diameter and a second upper cylindrical portion with a smaller diameter, the first lower cylindrical portion and the second upper cylindrical portion being coaxial with respect to each other, the first lower cylindrical portion with a larger diameter being internally threaded, so as to be configured to be positioned on a screw neck of a mouthpiece of the container, and the second upper cylindrical portion having a smaller diameter and forming pouring part of the cap, the second part comprises a covering lid having an annular portion below a lid portion and a hinge arrangement interposed between the annular portion and the lid portion, the hinge arrangement has a strip arranged in a window opening, which is formed in a side surface of the lid portion and which is open toward the annular portion, the strip comprises weakened foldable end areas connected to the annular portion and to the lid portion and a central folding invitation line, arranged longitudinally in the strip and dividing the strip into two portions between which a central recess is defined, second folding invitation lines being further provided between the two portions of the strip and the annular portion so that the lid portion is movable between a closed position above the first part and a completely open overturned position alongside the first part, and the second folding invitation lines are defined between the two portions of the strip and an end edge of the opening in the lid portion.

2. The cap according to claim 1, further comprising sealing means for the second upper cylindrical portion.

3. The cap according to claim 2, wherein the sealing means comprise a shutter that is axially movable with respect to the second upper cylindrical portion between a closed position and an open position of a connection hole for passage of a beverage between the first lower cylindrical portion and the second upper cylindrical portion.

4. The cap according to claim 2, wherein the sealing means comprise a shutter that extends from a wall positioned for closing the lid portion inwardly so as to engage with an open end of the second upper cylindrical portion.

5. The cap according to claim 1, wherein the weakened foldable end areas of the strip are connected to rigid connection sectors extending respectively from the annular portion and from the end edge of the opening in the lid portion with an interpositioning of the second folding invitation lines tilted and converging towards the central folding invitation line.

6. The cap according to claim 1, wherein the weakened foldable end areas of the strip are connected to opposite ends of the two portions of the strip by the second folding invitation lines.

7. The cap according to claim 1, wherein the two portions of the strip are arranged so that with the central recess and the central folding invitation line define a V-section in a transverse direction with respect to the strip.

8. The cap according to claim 7, wherein the two portions define sides of the V-section pointing outwardly in the closed position of the hinge arrangement with a tip of the V-section coinciding with the central folding invitation line.

9. The cap according to claim 7, wherein the two portions define sides of the V-section pointing inwardly in a completely open and overturned position of the hinge arrangement with a tip of the V-section coinciding with the central folding invitation line.

10. The cap according to claim 1, wherein the annular portion of the second part has an interior with a first perimetric annular projection protruding inwardly and snap-coupled with an second annular projection formed externally above a flanging provided in an upper part of the first lower cylindrical portion.

11. The cap according to claim 1, wherein the annular portion and the lid portion are at least partially connected to each other by a series of frangible bridges configured to break when the first and the second parts are opened.

12. The cap according to claim 11, wherein the annular portion and the lid portion are further connected to each other by a tamper-proof rod that is stably constrained and pivoted at a lower end to the annular portion and has further frangible bridges that connect the tamper-proof rod with the annular portion and the lid portion.

* * * * *